US010246974B2

(12) United States Patent
Greenway et al.

(10) Patent No.: US 10,246,974 B2
(45) Date of Patent: Apr. 2, 2019

(54) PUNCH AND CUT SYSTEM FOR TUBING

(71) Applicant: Schlumberger Technology Corporation, Sugar Land, TX (US)

(72) Inventors: Graeme Alastair Greenway, Pearland, TX (US); Mohamed Mehdi, Houston, TX (US); Matt Moreland, Shropshire (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 229 days.

(21) Appl. No.: 15/275,995

(22) Filed: Sep. 26, 2016

(65) Prior Publication Data

US 2018/0087352 A1 Mar. 29, 2018

(51) Int. Cl.
*E21B 29/02* (2006.01)
*E21B 43/117* (2006.01)

(52) U.S. Cl.
CPC ..... *E21B 43/117* (2013.01); *E21B 29/02* (2013.01)

(58) Field of Classification Search
CPC ..... E21B 43/116; E21B 43/117; E21B 29/02; E21B 43/11; E21B 43/118; E21B 43/1185; E21B 43/11852; E21B 31/00; E21B 31/002; E21B 31/16
USPC .... 166/55, 55.1, 55.2, 55.3, 55.6, 55.7, 55.8
See application file for complete search history.

(56) References Cited

U.S. PATENT DOCUMENTS

| | | | | |
|---|---|---|---|---|
| 2,555,069 | A | 5/1951 | Verney | |
| 2,873,675 | A * | 2/1959 | Lebourg | C06C 5/06 175/4.6 |
| 3,031,964 | A * | 5/1962 | Chesnut | E21B 43/117 102/319 |
| 4,688,640 | A * | 8/1987 | Pritchard, Jr. | E21B 29/12 166/297 |
| 2012/0199352 | A1* | 8/2012 | Lanclos | E21B 43/1185 166/297 |
| 2014/0096670 | A1* | 4/2014 | Bell | E21B 43/116 89/1.15 |
| 2015/0247370 | A1* | 9/2015 | Andrzejak | E21B 29/02 166/299 |
| 2015/0345245 | A1* | 12/2015 | Bell | E21B 43/117 102/310 |

FOREIGN PATENT DOCUMENTS

CN 201437699 U 4/2010

* cited by examiner

*Primary Examiner* — Brad Harcourt
*Assistant Examiner* — David Carroll

(57) ABSTRACT

A technique facilitates efficient punching and cutting of a tubing with a single trip downhole. A cutter and a puncher are combined and conveyed together downhole into a borehole, e.g. a wellbore. The cutter and puncher may be conveyed downhole via a suitable well string. A communications line may be routed to both the cutter and the puncher to enable selective actuation of the cutter and the puncher. For example, the puncher may initially be actuated by detonating a shaped charge to perforate through the tubing in the borehole. Subsequently, the cutter may be operated to sever the tubing. In some applications, the cutter may be replaced with another tool operatively coupled with the communications line.

18 Claims, 5 Drawing Sheets

PUNCH AND CUT SYSTEM FOR TUBING

BACKGROUND

In a variety of well applications tubing sections are separated and removed from a well. For example, an upper tubing section may be removed by cutting the tubing downhole and then retrieving the upper section to the surface. Removal of the upper tubing section can be useful in, for example, plug and abandon operations. However, sometimes a substantial pressure differential exists between the interior and exterior of the tubing and holes are punched through the tubing to provide pressure equalization prior to cutting the tubing and pulling the upper tubing section. These types of applications can be expensive and time-consuming and involve multiple trips downhole before the tubing section can be removed.

SUMMARY

In general, a system and methodology facilitate efficient punching and cutting of a tubing during a single trip downhole. A cutter and a puncher are combined and conveyed together downhole into a borehole, e.g. a wellbore. A communications line may be routed to both the cutter and the puncher to enable selective actuation of the cutter and the puncher. For example, the puncher may initially be actuated by detonating a shaped charge to perforate through the tubing in the borehole. Subsequently, the cutter may be operated to sever the tubing. In some applications, the cutter may be replaced with another type of tool operatively coupled with the communications line.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
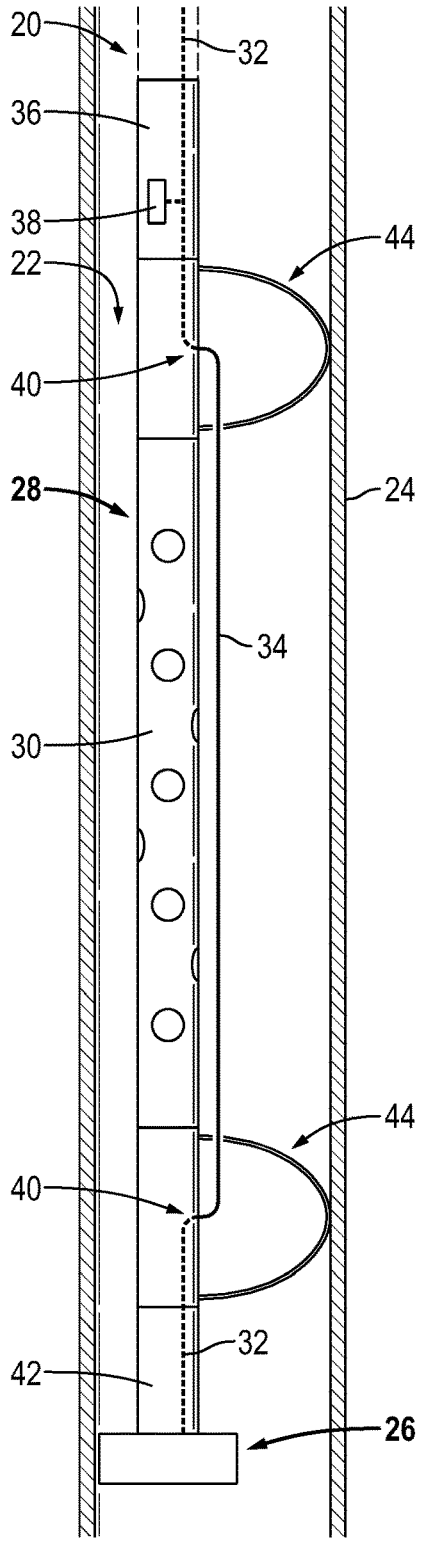
FIG. 1 is a schematic illustration of an example of a well string carrying both a cutter and a puncher downhole into a borehole in a single trip, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate efficient punching and cutting of a tubing during a single trip downhole. For example, a cutter and a puncher may be combined along a well string and conveyed together downhole into a borehole, e.g. a wellbore. A communications line may be routed to both the cutter and the puncher to enable selective actuation of the cutter and the puncher. The puncher may initially be actuated by detonating a shaped charge to perforate through a wall of the tubing in the borehole. Subsequently, the cutter may be operated to sever the tubing. By way of example, the cutter may comprise cutter shaped charges which are detonated to sever the tubing. The cutting allows an upper section of tubing to be removed from the borehole. In some applications, the communications line may be routed past the cutter, e.g. through a protected bypass, to provide a communication pathway to other tools below the cutter for communication of power and/or data signals. Additionally, the cutter may be replaced with other tools in some applications and the communications line may be routed to these other tools rather than the cutter.

According to an embodiment, a puncher and an explosive cutter may be run downhole into a wellbore in the same trip into the well. The puncher may then be fired prior to activation of the cutter. In some embodiments, the puncher may be placed at an eccentric position in the well and the cutter may be generally centered in the well below the puncher. An electrical connection to the cutter is provided by an electrical communications line which travels down along the well string and along a bypass outside the puncher. For example, the puncher may comprise a perforating gun having a gun body with shaped charges and the bypass may be routed external to the gun body and behind the shaped charges. Appropriate adapters may be used to provide a suitable electrical connection from the communications line to the perforating gun of the puncher and to cutter shaped charges of the cutter. This allows the puncher and cutter to be selectively activated via a surface control system. It should be noted that some embodiments may utilize a fiber optic communications line or a communications line which comprises at least some wireless portions between the surface control and the puncher, cutter, and/or other downhole tools.

The ability to utilize a puncher and a cutter during the same trip downhole creates substantial efficiency for a variety of punching and cutting operations. In such applications, the surrounding tubing may initially be punched for pressure equalization. The ability to independently control the puncher and the cutter enables a controllable delay prior to cutting as may be desired for certain job conditions. At a desired time subsequent to punching through the tubing, the cutter may be activated to sever the surrounding tubing so that the separated upper section of tubing may be pulled from the wellbore. The single trip punching and cutting capability substantially increases efficiency for many types of operations, e.g. plug and abandon operations, by eliminating additional trips into the well. It should be noted the system may be used in other operations, such as drill string recovery operations. In drill string recovery operations, the puncher may be used to punch through a tubing wall of the drill string to promote circulation in an effort to free the drill string. If the attempt is not successful, the cutter may be actuated to sever the drill string without an additional trip downhole.

Referring generally to FIG. 1, an example of a well string 20 is illustrated as deployed in a borehole 22, e.g. a wellbore. In this example, a tubing 24, e.g. a well pipe, is disposed in the borehole 22 and generally surrounds the well string 20. In a variety of applications, the tubing 24 may be in the form of a well tubing disposed within a well casing lining wellbore 22. In some applications, the tubing 24 may be the well casing. The well string 20 may be deployed downhole for a desired well servicing operation, such as a plug and abandon operation. In such an operation, a hole (or a plurality of holes) is punched through the tubing 24 and then the tubing 24 is severed and an uphole tubing section is separated from the remaining tubing. This allows the upper action of the tubing 24 to be retrieved from the borehole 22.

In the embodiment illustrated, the well string 20 comprises a cutter 26 oriented to enable severing of the tubing 24 at a desired downhole location in the borehole 22. The well string 20 further comprises a puncher 28 comprising, for example, at least one perforating gun 30 which may have a shaped charge or a plurality of shaped charges as described in greater detail below. In the example illustrated, the puncher 28 is positioned along well string 20 uphole from cutter 26. Additionally, a communications line 32 is routed along the well string 20 and is operatively coupled with the puncher 28 and the cutter 26. Depending on the application, the communications line 32 may comprise a plurality of communication paths, e.g. a plurality of conductive paths for electrical signals.

The communications line 32 may be located at least partially within well string 20 but also may comprise a communications line bypass 34 which is effectively a section of the communications line 32 routed past the perforating gun 30 externally of the perforating gun 30. Additionally, the communications line bypass 34 is positioned so that it is protected from damage during detonation of the perforating gun 30. For example, the communications line bypass 34 may be positioned on a side of the perforating gun 30 opposite the side experiencing the force of the detonated perforating charge or charges. In some embodiments, the communications line bypass 34 may be located behind the perforating charge(s) and externally of a gun body of the perforating gun 30.

Depending on the specifics of a given application and on the construction of well string 20, the communications line 32 may be coupled with a variety of components. For example, the communications line 32 may be coupled with a perforating gun firing head 36 having a detonator 38. Appropriate communications signals may be provided to firing head 36 and detonator 38 via the communications line 32 so as to initiate firing of perforating gun 30.

Additionally, a variety of communications line feed through systems 40 may be used to facilitate sealed entry of the communications line 32 at perforating gun 30 and/or to provide egress and ingress of the communications line 32 at communications line bypass 34. The communications line 32 also may be coupled with appropriate cutter hardware 42, e.g. communications circuitry, to enable selective control of cutter operation. In some embodiments, the cutter 26 may comprise cutter shaped charges, as discussed in greater detail below, and the cutter hardware 42 may comprise appropriate detonators and control circuitry that enable selective detonation of the cutter 26. For example, appropriate communications signals may initially be sent downhole from a surface control system via communications line 32 to initiate actuation of puncher 28, e.g. firing of perforating gun 30, to achieve an improved pressure balance and/or circulation between the interior and exterior of tubing 24. Subsequently, cutter communications signals may be sent downhole via communications line 32 to initiate operation of cutter 26 and to sever tubing 24.

The well string 20 also may comprise various other tools and features. For example, the cutter 26 may be replaced by a variety of tools or tools may be disposed below cutter 26. By way of example, the other tools may be used to enable performance of desired downhole operations in addition to a perforating operation or in addition to a punch and cut operation during the single trip downhole. In some embodiments, the communications line 32 is routed down through cutter 26 to enable transfer of power and/or data signals with respect to tools below cutter 26. Other devices, such as a biasing mechanism 44 may be used to position the puncher 28 and/or cutter 26 at desired radial positions within borehole 22. For example, the biasing mechanism 44 may be used to place puncher 28 at an eccentric position with respect to a central axis of tubing 24, thus moving perforating gun 30 into closer proximity with the internal surface of tubing 24.

Figure 2:
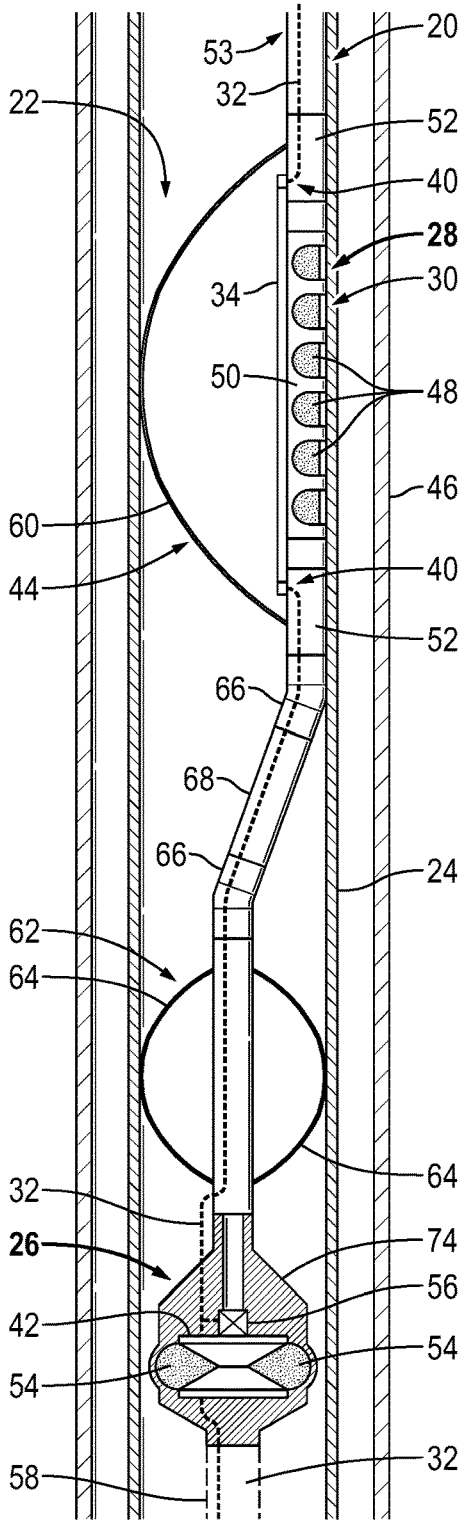
FIG. 2 is an illustration of an example of a well string system comprising a cutter and a puncher, according to an embodiment of the disclosure.

Referring generally to FIG. 2, an embodiment of well string 20 is illustrated as deployed within tubing 24 which, in turn, is positioned within a surrounding well casing 46. This embodiment of well string 20 again comprises puncher 28 and cutter 26. The puncher 28 is located uphole relative to cutter 26 and comprises the perforating gun 30 which has a plurality of shaped charges 48 mounted within a gun carrier body 50. The gun carrier 50 may be coupled with gun adapters 52, such as an upper gun adapter and a lower gun adapter. By way of example, at least one of the gun adapters 52 may comprise firing head 36 and/or detonator 38. Depending on the application, the shaped charges 48 may be detonated via detonator(s) 38 located above and/or below the shaped charges 48. It should be noted the well string 20 may comprise various components and features positioned above puncher 28. In the example illustrated, the upper gun adapter 52 is coupled with an upper assembly component 53 of the well string 20.

In the illustrated embodiment, the cutter 26 comprises a plurality of cutter shaped charges 54. Accordingly, the cutter hardware 42 may comprise appropriate circuitry and a detonator 56 to enable selective detonation of the cutter shaped charges 54. Both the puncher 28 and the cutter 26 are operatively coupled with communications line 32. For example, the communications line 32 may be coupled with detonator(s) 38 of gun adapters 52 and with detonator 56 of cutter 26. In some embodiments, the cutter 26 may be replaced with a tool or tools 58 to enable other types of operations in conjunction with use of puncher 28 during a single trip downhole. However, the tool or tools 58 also may be located below cutter 26 and the communications line 32 may bypass cutter 26. For example, the cutter 26 may comprise a protective enclosure for routing the communications line 32 pass the cutter shaped charges 54. The construction of well string 20 enables operation of the tools 58 (with or without cutter 26) independently of operation of puncher 28 during a single trip downhole. It should be noted the cutter 26 may comprise multiple cutters 26 to provide, for example, redundancy. In some operations, the multiple cutters 26 can be fired sequentially from the bottom cutter 26 until successful severing of the tubing 24 is achieved.

To facilitate the punching and cutting of tubing 24, some embodiments utilize biasing mechanisms positioned along the well string 20 to bias the puncher 28 and the cutter 26 to desired radial positions within tubing 24 and borehole 22. For example, biasing mechanism 44 may be positioned to bias puncher 28 and its shaped charges 48 against or into close proximity with the interior surface of tubing 24. By way of example, the biasing mechanism 44 may be in the form of a spring 60, e.g. a bow spring, coupled to puncher 28 or to components proximate puncher 28. In the illustrated example, the spring 60 is mounted on a side of the puncher 28 opposite the side to which shaped charges 48 are oriented and acts against tubing 24 to move the shaped charges 48 toward the desired eccentric position along the interior surface of tubing 24. In some embodiments, the biasing mechanism 44 comprises a permanent magnet which biases the puncher 28 toward the inner surface of tubing 24. Bypass 34 also may be located on the same side of puncher 28 as spring or springs 60.

Similarly, a biasing mechanism 62 may be positioned at or proximate cutter 26 to bias the cutter 26 to a desired position within tubing 24 and borehole 22. In the example illustrated, the cutter biasing mechanism 62 is in the form of a centralizer having a plurality of biasing members, e.g. springs 64. The springs 64 may be positioned about the well string 20 in a manner which biases the cutter 26 toward a central position, e.g. along a central axis, of the interior of tubing 24. By shifting the cutter 26 to a center of tubing 24, a more uniform and reliable severing of the tubing 24 may be achieved. In the illustrated embodiment, the cutter 26 is shifted to a central position via cutter biasing mechanism 62 and cutter shaped charges 54 are disposed about the circumference of cutter 26. This arrangement ensures tubing 24 is properly severed upon detonation of cutter shaped charges 54.

The desired radial shifting of puncher 28 and/or cutter 26 may be achieved by coupling cutter 26 to puncher 28 via appropriate well string components having the desired flexibility. By way of example, the well string 20 may comprise at least one flex joint 66, e.g. a knuckle joint, positioned between cutter 26 and puncher 28. In the specific embodiment illustrated, a tubular spacer or spacers 68 may be positioned between a plurality of the flex joints 66, e.g. two flex joints 66, to facilitate positioning of puncher 28 and cutter 26. As illustrated in FIG. 2, this arrangement of flex joints 66 and tubular spacers 68 enables biasing of puncher 28 to an eccentric position with respect to a central axis of tubing 24 while cutter 26 is biased to a central position within tubing 24. Thus, the puncher 28 may be shifted off-axis relative to the cutter 26. Various types of biasing mechanisms 44, 62 may be used to shift the cutter 26 and puncher 28 to desired positions.

Figure 3:
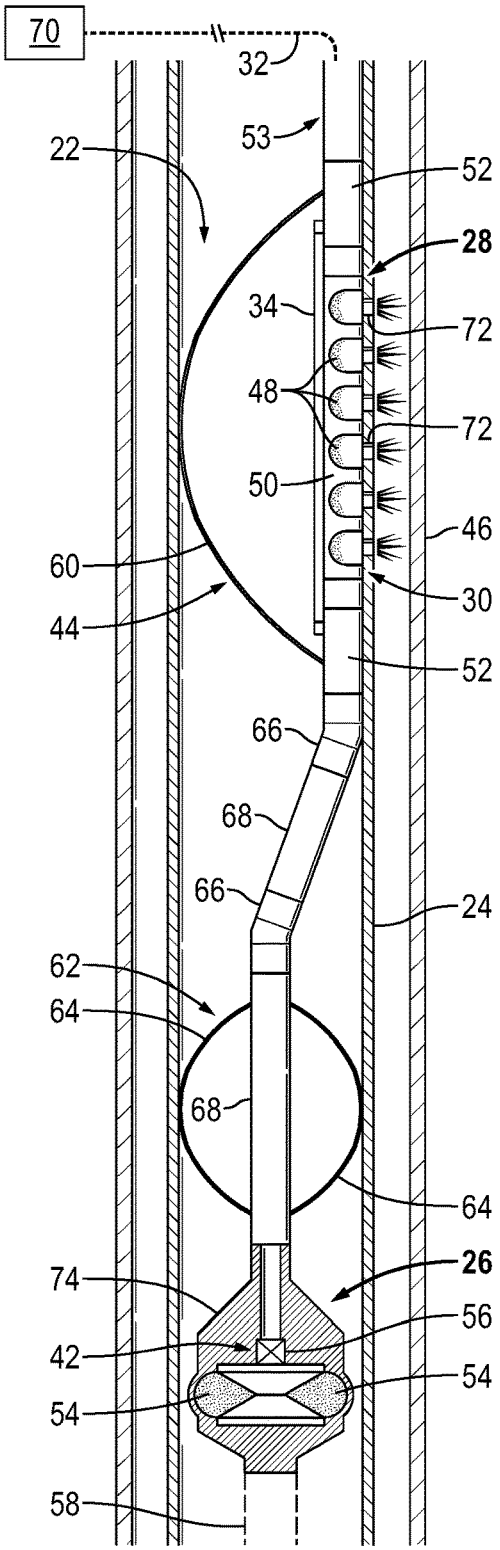
FIG. 3 is an illustration similar to that of FIG. 2 but at a subsequent operational stage, according to an embodiment of the disclosure.

In an operational example, the well string 20 is deployed downhole along an interior of tubing 24 to a desired location. The biasing mechanisms 44, 62 may be used to maintain or to shift the puncher 28 and the cutter 26 to the desired radial positions within tubing 24. Once in position, a communications signal is sent along communications line 32 from a surface communications system 70 to the appropriate gun adapter 52 having firing head 36 and detonator 38. The communications signal actuates detonator 38 and causes the perforating gun 30 to fire. In other words, the shaped charges 48 are detonated and create sufficient explosive force to form perforations 72 through the wall forming tubing 24, as illustrated in FIG. 3. In a variety of applications, the shaped charges 48 are constructed and loaded to form a relatively shallow jet and large perforation hole. Once the perforations 72 are formed, pressure imbalance between an exterior and interior of tubing 24 may quickly equalize. In other operations, e.g. drill string recovery operations, the perforations 72 may be formed to promote circulation in an effort to free the drill string. Regardless of the specifics of a given operation, communications line bypass 34 and its position along the well string 20 protects the communications line 32 from the effects of the detonation.

Figure 4:
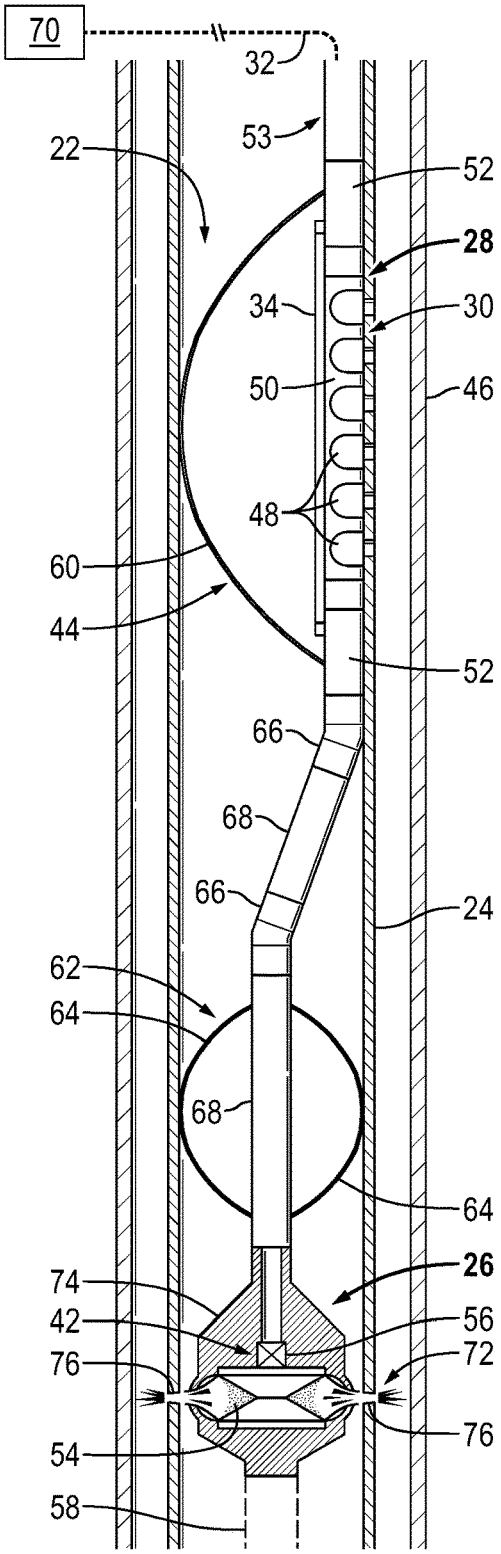
FIG. 4 is an illustration similar to that of FIG. 3 but at a subsequent operational stage, according to an embodiment of the disclosure.

After a desired period of time, the cutter 26 may be operated. In this example, a cutter communications signal is sent along communications line 32 from the surface communications system 70 to the communications circuitry and detonator 56 of cutter hardware 42. The communications signal actuates detonator 56 and causes the cutter shaped charges 54 to detonate. As illustrated, cutter shaped charges 54 may be arranged about the circumference of a cutter body 74 so that cutting force is directed radially outward along at least a substantial portion of the circumference of tubing 24. As a result, a cut 76 is formed along the entire circumference of tubing 24 and the tubing 24 is severed, as illustrated in FIG. 4.

Figure 5:
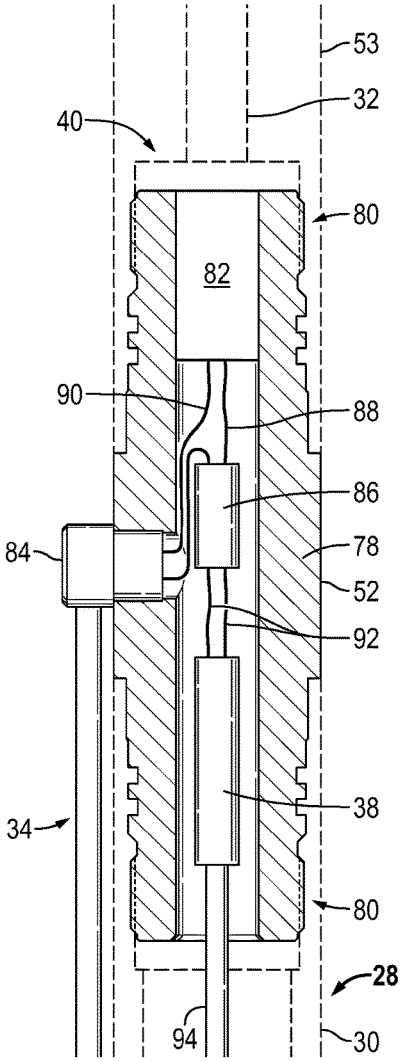
FIG. 5 is a cross-sectional illustration of a portion of the well string comprising a detonator and associated circuitry for selectively detonating at least one shaped charge, e.g. a shaped charge of the puncher, according to an embodiment of the disclosure.

Referring generally to FIG. 5, an embodiment of the upper gun adapter 52 is illustrated. In this example, the upper gun adapter 52 comprises an adapter body 78 having coupling ends 80 by which the gun adapter 52 may be coupled with upper assembly 53 and perforating gun 30 of puncher 28. In this embodiment, communications line 32 is routed into upper gun adapter 52 via a pressure bulkhead and feed through 82 which may be part of the overall feed through system 40. Additionally, the communications line 32 may be routed to communications line bypass 34 via a communications line plug 84.

The communications line 32 also may be coupled with various components located within body 78 of upper gun adapter 52. For example, the communications line 32 may be coupled with a switch 86 via a perforating gun hot wire 88 of communications line 32. The communications line 32 also may comprise a feedthrough communication line 90 routed through communications line plug 84 to bypass 34 for controlling downhole components, such as cutter 26. Accordingly, the communications line 32 may comprise sections of internal communications line which are internal to the well string 20 and/or perforating gun system and sections of external communications line which are external to the perforating gun system.

In this example, switch 86 may be an addressable switch, such as the Addressable Switch Firing System (ASFS) available from Schlumberger Corporation. The switch 86 may be coupled with detonator 38 via communication lines 92, e.g. wires, disposed within body 78 of upper gun adapter 52. In this example, the detonator 38 is connected with a detonator cord 94 which is routed into the corresponding gun carrier 50 of perforating gun 30 and to the corresponding shaped charge or charges 48. In operation, appropriate signals may be sent to switch 86 to selectively initiate detonator 38 for detonation of shaped charges 48 or to selectively communicate with cutter 26 to initiate operation of cutter 26.

Figure 6:
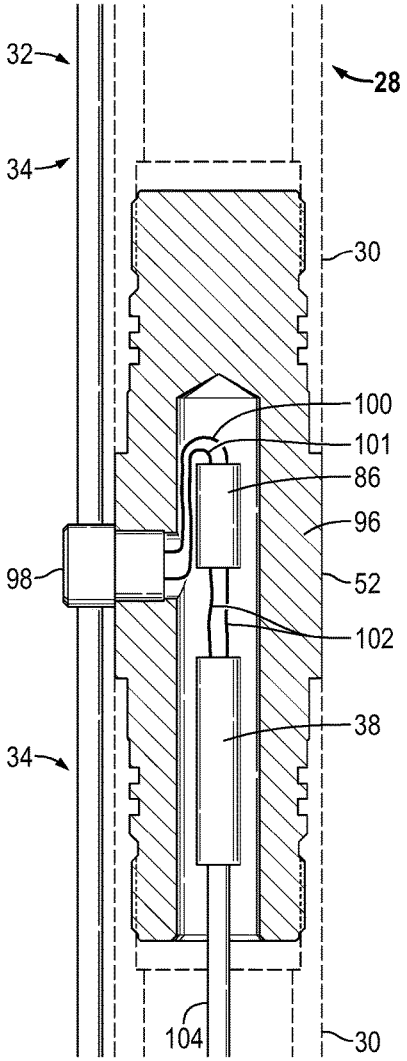
FIG. 6 is a cross-sectional illustration of another embodiment of a portion of the well string comprising a detonator associated circuitry, according to an embodiment of the disclosure.

Referring generally to FIG. 6, an embodiment of gun adapter 52 is illustrated in the form of an intermediate gun adapter having an intermediate gun adapter body 96. By way of example, the intermediate gun adapter 52 may be used in embodiments in which puncher 28 is constructed with a plurality of perforating guns 30. In the embodiment illustrated, the intermediate gun adapter body 96 of intermediate gun adapter 52 is coupled between upper and lower perforating guns 30 of puncher 28. In some embodiments, additional intermediate gun adapter(s) 52 may be positioned between additional perforating gun(s) 30.

As illustrated, communications line 32 may be routed into intermediate gun adapter body 96 of intermediate gun adapter 52 via a communications line plug 98 coupled into communications line bypass 34 at an intermediate position. The communications line 32 may be coupled with various components located within body 96 of intermediate gun adapter 52. For example, the communications line 32 may be coupled with another switch 86 via a perforating gun hot wire 100 and a feedthrough communication line 101 routed through communications line plug 98 and into the interior of intermediate gun adapter body 96.

In this example, the switch 86 may again be an addressable switch, such as the ASFS addressable switch firing system available from Schlumberger Corporation. The switch 86 of intermediate gun adapter 52 may be coupled with another detonator 38 associated with the lower perforating gun 30. By way of example, the intermediate switch 86 may be coupled with the corresponding detonator 38 via communication lines 102, e.g. wires, disposed within the intermediate gun adapter body 96. In this example, the detonator 38 is connected with a lower detonator cord 104 which is routed into the corresponding gun carrier 50 and to the corresponding shaped charge or charges 48 of the lower perforating gun 30.

In operation, appropriate signals may be sent to the upper and/or lower switches 86 to selectively initiate the detonator or detonators 38 for detonation of desired shaped charges 48. However, regardless of the number of detonators 38 and corresponding perforating guns 30, the communications line bypass 34 remains on a protected side of the well string 20 to ensure appropriate communications signals may be sent to cutter 26 and/or to other downhole tools. This allows initial perforation of tubing 24 to balance pressures and subsequent communication with cutter 26 to, for example, sever the tubing 24.

Depending on the specifics of a given application, the well string 20 may comprise a variety of additional and/or other features and components. For example, a variety of communications line plugs 84, 98 or other mechanical connectors may be used to facilitate stable communication, e.g. electrical communication, to the cutter 26 or other downhole components following an uphole explosion, e.g. detonation of shaped charges 48. The communications line 32 may be routed through such mechanical connectors and other protective features along desired pathways which may comprise pathways routed within well string components and external to well string components, e.g. external to perforating guns 30. In some applications, at least portions of the communications line 32 may be routed into or through portions of a perforating gun body. Additionally, the communications line 32 may comprise various protective coverings, e.g. enclosures, mounted along the well string 20.

Various protective features, e.g. protective housings, also may be utilized with corresponding orientation features. For example, protective features may be combined with the biasing mechanisms 44, 62. The biasing mechanisms 44, 62 also may be constructed for dependable operation in a variety of downhole environments, and may comprise bow springs, magnetic positioning devices, e.g. a permanent magnet, expandable rubber elements, powered spring devices, powered arm devices, and/or other devices which may be utilized in a downhole environment to position the puncher 28 and the cutter 26 at desired radial positions within tubing 24.

Additionally, various types of switches 86, control circuitry, signal processing circuitry, and/or other control features may be used to enable selective firing of the puncher 28 and cutter 26. Various mechanical and electrical crossovers as well as pressure tight feedthroughs may be used in combination with communications line 32. In some applications, shock dampening components, e.g. shock dampening materials, may be combined into the well string 20. The specific components and features may be selected according to the parameters of a given operation, e.g. a plug and abandon tubular cutting operation or a drill pipe recovery operation.

Protecting communications line 32 with bypass 34 and/or other features ensures continued communication of signals, e.g. communication of electrical signals, before, during, and/or after detonation of the perforating guns 30. Consequently, many types of tools 58 may be combined into well string 20 for use during the single trip downhole. Examples of tools 58 comprise milling tools which can be used to enable milling operations during the single trip downhole in, for example, mill and shoot or clean and shoot operations. The tools 58 also may include a shifting tool to enable single trip shift and perforating operations. Additional examples of tools 58 include linear actuators and anchors which can be combined into the well string 20 to help mitigate sticking of the well string if, for example, sanding occurs. Tools 58 in the form of anchors can be helpful when anchoring of the perforating gun(s) is desired. The tools 58 also may comprise a variety of instrumented tools, such as many of the ReSOLVE™ tools available from Schlumberger Corporation.

Accordingly, well string 20 may be constructed in a variety of arrangements to facilitate the specific parameters of many types of downhole operations during a single trip downhole. When punching and cutting tubing during a single trip downhole, the time spent handling explosives at the surface is substantially reduced compared to using separate runs. Embodiments of well string 20 also help reduce rig-up and rig-down time. The components of cutter 26, puncher 28, and/or tools 58 may be selected to accommodate many types of downhole operations during the single trip downhole.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for servicing a well, comprising:

a well string having:

a cutter positioned to sever a well pipe disposed in a wellbore;

a puncher oriented along the well string uphole from the cutter, the puncher comprising a perforating gun having at least one shaped charge selectively detonated via a detonator; and a communications line routed along the well string to the detonator of the puncher and to the cutter, the communications line having a communications line bypass which routes the communications line externally past the perforating gun on a side of the perforating gun which is protected from the at least one shaped charge during detonation.

2. The system as recited in claim 1, wherein the cutter comprises a plurality of cutter shaped charges oriented to sever the well pipe upon detonation of the plurality of cutter shaped charges.

3. The system as recited in claim 1, wherein the at least one shaped charge of the puncher comprises a plurality of shaped charges.

4. The system as recited in claim 1, wherein the puncher comprises a plurality of perforating guns.

5. The system as recited in claim 1, wherein the well system further comprises a biasing mechanism positioned to bias the puncher against an inside surface of the well pipe.

6. The system as recited in claim 5, wherein the biasing mechanism comprises a spring member.

7. The system as recited in claim 5, wherein the biasing mechanism comprises a bow spring.

8. The system as recited in claim 1, wherein the well string further comprises a centralizer positioned to centralize the cutter in the wellbore.

9. The system as recited in claim 1, wherein the well string further comprises a tubing and at least one flex joint positioned between the puncher and the cutter to enable movement of the puncher off-axis relative to the cutter.

10. A method, comprising:

conveying a puncher and a tool, located below the puncher, downhole into a borehole in a single run of a well string;

detonating a shaped charge of the puncher, in response to a communication signal received via a communications line, to perforate through a tubing in the borehole;

subsequently operating the tool in the borehole in response to a subsequent communication signal received via the communications line, and routing at least a portion of the communications line externally of the puncher and past the puncher along a side protected from detonation of the shaped charge, wherein subsequently operating the tool comprises subsequently operating a cutter to sever the tubing.

11. The method as recited in claim 10, further comprising constructing the puncher with at least one perforating gun having a plurality of the shaped charges.

12. The method as recited in claim 10, further comprising biasing the puncher laterally against an inside surface of the tubing via a permanent magnet.

13. The method as recited in claim 10, further comprising biasing the puncher laterally against an inside surface of the tubing via a spring.

14. The method as recited in claim 10, further comprising biasing the cutter toward a central position in the borehole.

15. The method as recited in claim 14, further comprising using a flex joint along the well string between the puncher and the cutter.

16. The method as recited in claim 10, further comprising operating the puncher in a drill string retrieval operation.

17. A system, comprising:

a puncher having a shaped charge oriented outwardly to enable punching of a hole through a surrounding tubing;

a cutter coupled to the puncher and having a plurality of cutter shaped charges oriented to enable severing of the surrounding tubing; and a communications line coupled to both the puncher and the cutter to provide signals for controlling detonation of the shaped charge and the plurality of cutter shaped charges at separate times, wherein the puncher and the cutter are deployed along a well string comprising at least one additional tool located below the cutter, the communications line also being operatively coupled with the at least one additional tool.

18. The system as recited in claim 17, further comprising biasing mechanisms positioned to bias the puncher laterally toward the surrounding tubing and to bias the cutter toward a center of the surrounding tubing.

* * * * *